United States Patent [19]

von Klinggräff et al.

[11] 4,175,891

[45] Nov. 27, 1979

[54] AUXILIARY WALKING MINE SUPPORT

[75] Inventors: Gerhard von Klinggräff, Neukirchen-Vluyn; Peter Marr; Karlheinz Bohnes, both of Bochum, all of Fed. Rep. of Germany

[73] Assignee: Bochumer Eisenhütte Heintzmann GmbH & Co., Bochum, Fed. Rep. of Germany

[21] Appl. No.: 950,536

[22] Filed: Oct. 10, 1978

[30] Foreign Application Priority Data

Oct. 8, 1977 [DE] Fed. Rep. of Germany ..... 2745358

[51] Int. Cl.[2] ..... E21D 15/44

[52] U.S. Cl. ..... 405/291

[58] Field of Search ..... 405/291-302; 299/31-33; 91/170 MP; 248/357

[56] References Cited

U.S. PATENT DOCUMENTS 2,801,522 8/1957 Kuhn ..... 405/297

FOREIGN PATENT DOCUMENTS 1802445 5/1970 Fed. Rep. of Germany ..... 405/295
2557255 7/1977 Fed. Rep. of Germany ..... 405/299
232897 12/1969 U.S.S.R. ..... 405/291

*Primary Examiner*—Dennis L. Taylor
*Attorney, Agent, or Firm*—Michael J. Striker

[57] ABSTRACT

A walking mine support unit has a pair of adjacent supporting frames each having a multi-partite sole plate and a multi-partite roof shield. The sole plate and roof shield of each frame are connected only at their respective leading and trailing ends, by hydraulic rams which permit the roof shields to be raised and lowered relative to the sole plates, and by four-bar linkages which permit length-wise displacement of the roof shields parallel and relative to the sole plates. A multi-section overshield is located above each of the roof shields and connected thereto by adjustable supports. An arrangement is provided for advancing the unit in stepwise manner.

15 Claims, 4 Drawing Figures

AUXILIARY WALKING MINE SUPPORT

BACKGROUND OF THE INVENTION

1. Field of the Invention

The present invention relates to mining equipment.

More particularly, the invention relates to mine supports.

Still more specifically, the present invention relates to auxiliary walking mine supports.

2. The Prior Art

In all underground mining operations it is essential that the overburden be properly supported, to prevent collapse of the roof. Many advances have been made in this respect. However, despite the modern advances the transitional zone between the roadway (main gallery) and the face continues to be a critical area in this respect.

One of the problems is that the mining equipment used in the roadway (e.g. conveyors) and the mining equipment used at or near the face (e.g. coal-mining machinery) overlaps in this transitional zone, in the sense that it is this zone where the different types of equipment interface with one another. Also, operations are carried out in this zone which are subject to different timing cycles. For example, the mined coal or the like must be transmitted from the face conveyors to the roadway conveyors, the conveyors and/or mining machines must be advanced (i.e. "walk") in accordance with the progress of the mining operation, and packing must be effected.

As a rule, the drives for the mining machines and/or the face conveyors extend into the roadway. This means that as these items of equipment advance along the mine face (and hence also lengthwise of the roadway which extends generally parallel to the mine face), the permanently installed roadway supports must be removed ahead of the advancing equipment and be reinstalled behind it. For the duration of its removal, the overburden must be supported by auxiliary supporting equipment. All of the above must, of course, be accomplished in the most expeditious manner possible, since it must not interfere with such other functions as haulage, movement of mine personnel and mine ventilation.

For purposes of such support it is known to provide auxiliary supporting equipment which, heretofore, was a type that could be clamped, bolted or otherwise connected to the roadway supports. This equipment includes e.g. supporting shields and other elements which are braced from below by pit props. As coal removal progresses along the mine face, this equipment must frequently be disassembled, moved along the mine face to new locations and be reassembled. Given the relative frequency of such moves and the relatively large number of components involved in assembly and disassembly, it is clear that such operations are time-consuming and highly labor-intensive. Moreover, the frequent moves tend to change the equilibrium of the overburden so that disassembly and reassembly of the equipment usually requires the ability to make on-the-spot improvisation to accommodate for unexpected or changing conditions. This, in turn, means that the operations must be carried out by skilled miners, rather than by auxiliary personnel, and makes the whole procedure even more costly. In addition, damage to the various components, as well as to the coal-mining and coal-conveying equipment and to the roadway supporting equipment, is almost unavoidable. This is costly and, in the case of damage to the roadway supports, makes it even more difficult to carry out the assembly and disassembly operations.

The seam area of the face adjacent the roadway (i.e. the aforementioned transitional area) is also the area in which the drive equipment for the coal-mining and coal-conveying machines is located. This is the reason for the need to remove the stationary uprights while this equipment passes through. Because of this it has heretofore been customary to temporarily support this transitional area by means of individual hydraulic pit-props which, in effect, define a kind of travelling buffer zone between the face and the roadway supports. The term "travelling" here denotes the fact that after the mining equipment has passed a given location, the pit-props are moved along with it and in the vacated location the stationary uprights are reinstalled. Again, the release and resetting of these pit-props is carried out manually. Aside from the cost and the loss of time involved, the setting of these props (and the effectiveness of support offered) are dependent upon the skill of the workers, which means again that experienced miners must be used although even in that case there can never be any guarantee that human error might not cause difficulties of a miner, of possibly even catastrophic nature.

Prior attempts to overcome the problems outlined above have not been satisfactory, for a variety of reasons, and an acceptable solution to those problems has heretofore eluded the industry.

SUMMARY OF THE INVENTION

Accordingly, it is an object of this invention to overcome the disadvantages of the prior art.

A more particular object is to provide an improved auxiliary mine support which avoids those disadvantages.

Still another object is to provide such an auxiliary support which is capable of reliably supporting the overburden in the transitional zone between roadway and face.

An additional object is to provide a support of the type in question which can be employed without requiring any significant manual operation and the utilization of which does not presuppose particular improvisational skills on the part of the users.

Pursuant to the above objects, and still others which will become apparent hereinafter, one aspect of the invention resides in an auxiliary walking mine support. Briefly stated, such a support may comprise a pair of adjacent supporting frames each having a multipartite sole plate and a multipartite roof shield, four-bar linkages connecting the sole plate with the roof shield of each frame, vanes supporting the roof shield of each frame on the sole plate thereof with freedom of vertical adjustment, a multi-section overshield above each of the roof shields, a plurality of supports connecting each multi-section shield to the respective roof shield, and means for effecting step-wise advancement of the frames relative to one another in direction lengthwise of the roadway.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
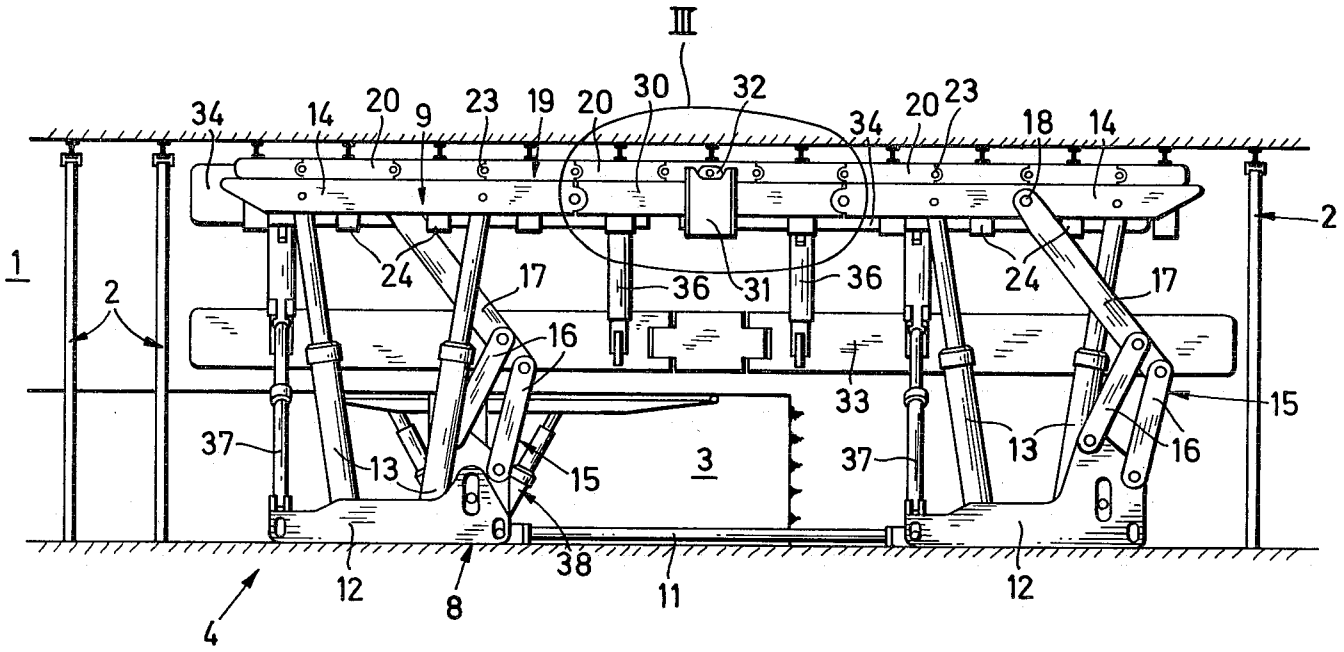
FIG. 1 is a somewhat diagrammatic vertical longitudinal section through a roadway into which a face gallery opens, showing an auxiliary mine support according to the invention in a side view.
Figure 2:
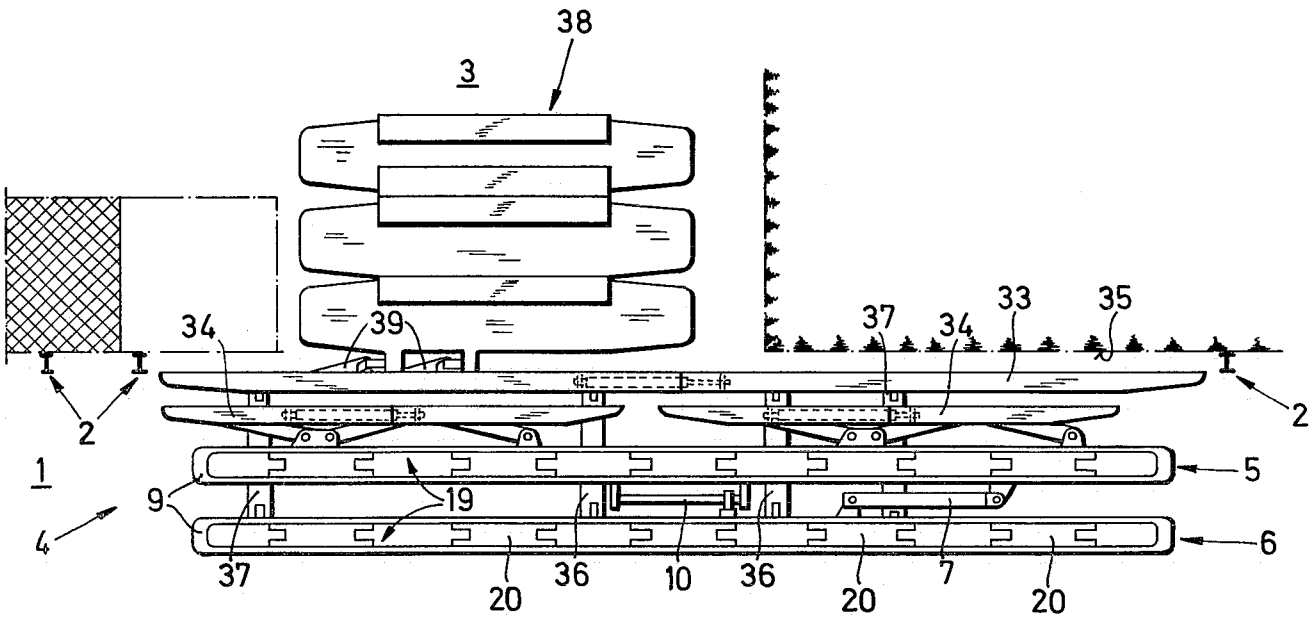
FIG. 2 is a diagrammatic vertical section through the transitional zone between the roadway and face gallery of FIG. 1, showing the auxiliary mine support in a top-plan view.

One embodiment of the invention is shown by way of example and for purposes of explanation in FIGS. 1–4. As seen in FIGS. 1 and 2, the reference numeral 1 designates a roadway (main gallery) which is provided with permanent supports 2. These are of the door-frame type, i.e. they each have a lintel supporting the overburden and two uprights which are located at opposite sidewalls of the roadway 1 and support the lintel. The uprights and the lintel are preferably of double-T steel beams.

A face gallery 3 opens into the roadway 1; it is supported against collapse by conventional supports which are known per se and hence not illustrated. Also not illustrated is the mine equipment (e.g. conveyors and the like) normally present in the roadway 1 and in the face gallery 3, since it forms no part of the invention.

The mining equipment in face gallery 3 moves stepwise according to the removal of coal or the like from the face (not shown), either to the left or to the right in FIG. 1. It follows that the supports 2 in FIG. 1 which are located ahead of the moving equipment must be removed (at least that upright of each support 2 which is located at the sidewall of roadway 1 where the face gallery 3 enters) and must be reinstalled behind the moving equipment. During the time for which these uprights are absent, the overburden must be held against collapse, by auxiliary supporting equipment.

This is provided, in roadway 1, in form of a roadway support unit 4 composed of two adjacent frames 5 and 6. The spacing of the frames 5 and 6 from one another advantageously corresponds to about their thickness in direction normal to the elongation of the roadway 1. The frames each have a sole plate 8 and a roof shield 9; they are connected by hydraulic rams 7 (see FIG. 2) which effect their stepwise advancement ("walking") along the roadway 1. It is known that for such advancement one of the frames (5 or 6) is anchored against the roof in known manner, and the other frame is pushed or pulled (as the case may be) along the roadway by operation of the rams 7. The latter may be installed in the region of the sole plates 8 and/or of the roof shields 9. Guide elements 10 (see FIG. 2) may also be provided for guiding the frames 5, 6 in a predetermined orientation during their relative movements.

The sole plate 8 of each frame 5, 6 is of three parts (FIG. 1), namely a flat center part 11 and two end sections 12 with which it is coupled for vertical displacement. Similarly, the roof shields 9 of each of the frames 5, 6 are of tripartite construction, having a central section 30 and two terminal sections 14. Hydraulic rams 13 are mounted on the end sections 14 of the roof shields 9.

The end sections 12 are additionally articulately coupled with the end sections 14 via four-bar linkages 15, each having two links 16 which are pivoted to a raised portion of the end sections 12 (FIG. 1) and the coupling members 17 are pivoted with one end to the free ends of the links 16 and with their other ends to the roof shields 9. Both of the linkages 15 are oriented in one and the same direction. The pivot axes 18, where the members 17 are connected to the roof shields 9, thus will perform a predominantly vertical movement when the roof shields 9 are raised and lowered, so that a movement of the roof shields in direction parallel to the sole plates 8 is assured. This arrangement facilitates the removal of the supports 2 ahead of unit 4 and their reinstallation behind it.

Figure 3:
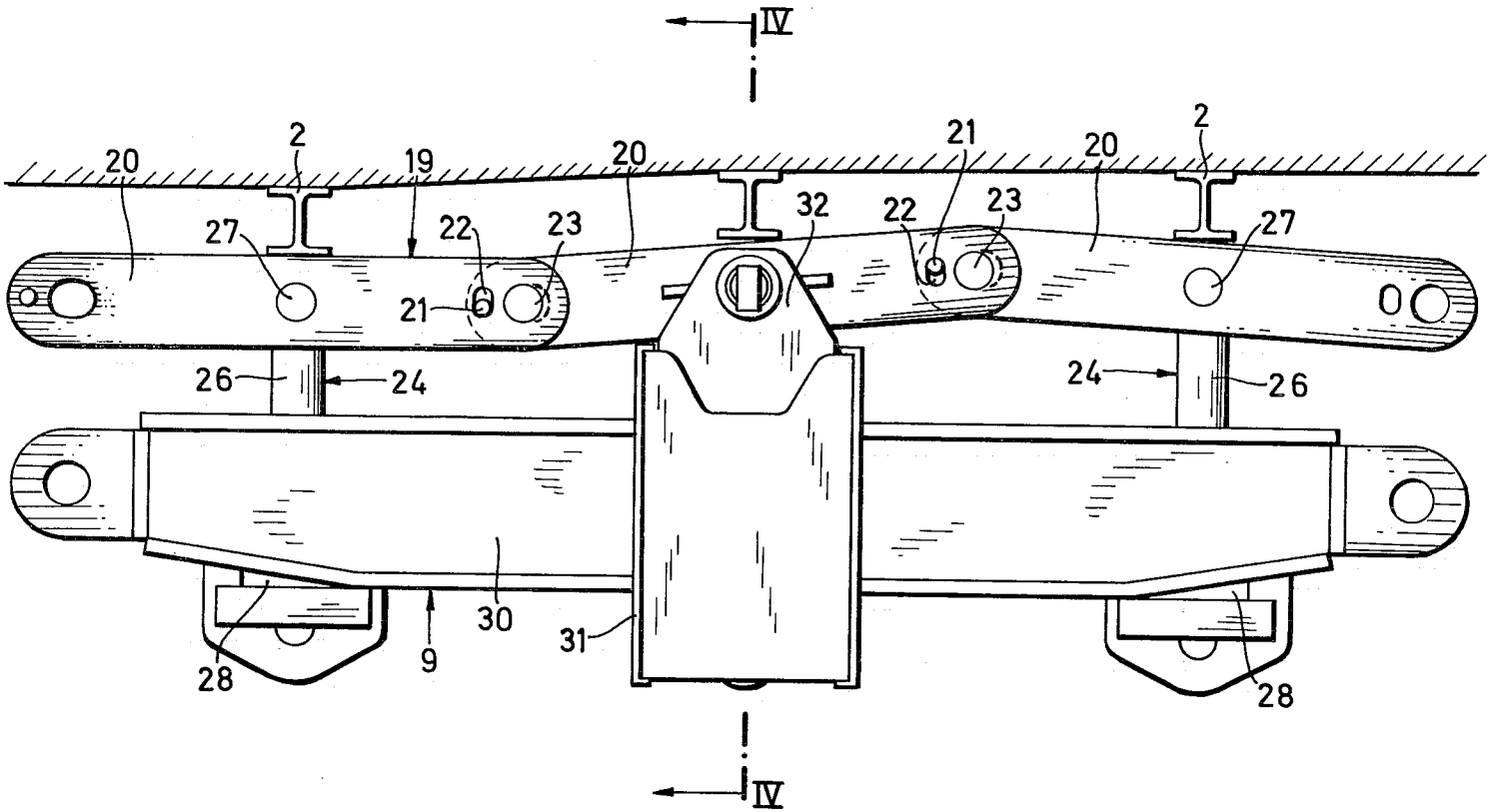
FIG. 3 is an enlarged view of the detail III of FIG. 1.

Above the roof shields 9 are provided multi-section (articulated) shields 19 having in vertical direction a thickness which is smaller than that of the roof shields 9. The shields 19 are each composed of a plurality of relatively short shield sections 20 having a length which is about equal to the spacing between two successive ones of the stationary supports 2. The ability of the sections 20 to pivot vertically relative to one another is limited by bolts or pins 21 on each section 20, which extend into corresponding slots or grooves 22 of the respectively adjacent section 20 (FIG. 3). Furthermore, the section 20 can also shift lengthwise relative to one another by a limited extent; a simple manner of making this possible is to make the transverse holes (via which a pivot shaft 23 of one section 20 extends through the adjacent section) of oval cross-section with the major axis of the oval extending lenghtwise of the respective section 20.

Figure 4:
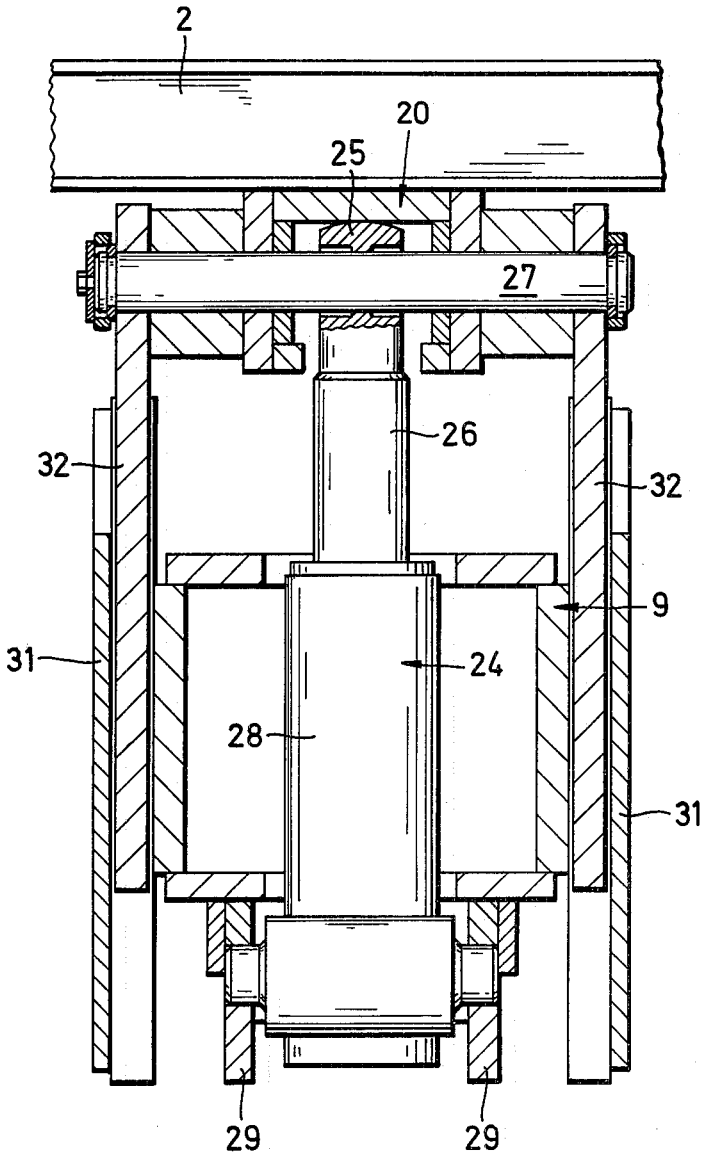
FIG. 4 is a section, on an enlarged scale, taken on line IV—IV of FIG. 3.

The sections 20 are each connected with the respective roof shield 9 by a hydraulic ram 24 (see also FIG. 4). Each arm 24 has a cylinder 28 and a piston provided with a piston rod 26 having a head 25. The head 25 of each piston rod 26 is pivoted on a shaft or bolt 27 extending transversely through the respectively associated section 20 and the cylinder 28 extends through openings in the roof shield 9 (see FIG. 4) and is pivotally connected below the roof shield to a bifurcated member 29. Illustration of the known-per-se hydraulic lines has been omitted in all instances for the sake of clarity.

The midpart of the roof-shield center section 30 is provided at opposite sides with housings 31 in which vertical guide members 32 are guided for vertical movement, with a slight amount of play. The upper end portion of the members 32 are pivotably connected to the shafts or bolts 27 of those sections 20 which are located above the housings 31 (FIG. 3).

As mentioned before, it is usually not the entire support 2 which is removed in the path of the advancing equipment, but only that one of the uprights of each support 2 which is located at the sidewall (designated in FIGS. 1 and 2 with reference numeral 35) where the face gallery 3 opens into the roadway 1. To support this sidewall 35 during the absence of the removed uprights, the unit 4 is provided with lateral shields 33 and 34 which advantageously are also composed of articulated sections. Hydraulic rams 36, 37 serve to press these lateral shields against the wall 35; they are pivoted to the sole plate 8 and to the roof shield 9 of at least one of the frames 5, 6.

A seam support unit 38 (FIGS. 1 and 2) may be arranged in the region where the gallery 7 opens in the roadway 1. This unit 38 may be coupled with the unit 4, for example via inclined four-bar linkages 39 (diagrammatically shown in FIG. 2), so that the units 4 and 38 can advance lengthwise of the roadway 1 together, i.e. jointly or successively.

In operation, the rams 13 serve to raise and lower the roof shields 9 and the linkages 15 assure that for advancement purposes the roof shield will be displaced parallel to the sole plate 8. Since both the roof shield and the sole plate of each frame 5, 6 are of tripartite construction, the unit 4 can accommodate itself much more readily to changes in the height of the roadway 1 than would be possible if both (especially the roof shield 9) were rigid and of one piece. This increases the available space beneath the roof shields 9 and thus offers more space for the mining personnel and equipment. Despite this, however, the roof shields are sufficiently strong and resistant to twisting and bending to be able to serve as the supports for the multi-section shields 19.

Since during advancement of the unit 4 the rams 24 can be substantially retracted within the confines of the roof shields 9, and since the shields 19 are substantially thinner in vertical direction than the shields 9, the combined height of each shield 9 and the associated shield 19 is not very much in excess of the height of the shield 9 alone. This facilitates advancement of the unit 4 in the relatively low roadways. In operation, however, the sections 20 of the shields 19 can be pressed against the lintels of each of the supports 2. This means that, as considered in the longitudinal direction of the unit 4, all of the supports 2 are supported substantially uniformly and in a well-defined manner so that, in turn, the overburden is uniformly supported against changes in its equilibrium. Since the multiple sections 20 can closely accommodate themselves not only the roof and the lintels of the supports 2, but also to the subjacent roof shield 9 when the latter is raised to contact their underside, the presence of the shields 19 does not materially detract from the available height below the roof shields 9. No parts of the entire unit 4 need be disassembled and reassembled manually in preparation for, or subsequent to, advancement of the unit. This eliminates the problems heretofore experienced in the prior art, including the disengagement and reengagement of hydraulic connections.

The ability of the sections 20 to pivot vertically relative to one another need not necessarily be limited, as described and illustrated heretofore. It is, however, advantageous to do so because it prevents the section 20 from assuming strongly inclined positions relative to the roof shields; this would reduce the vertical supporting force and undesirably convert it into a force having a predominant component in longitudinal direction of the roadway 1. Giving the sections 20 slight freedom of relative lengthwise movement, as described earlier, serves to compensate for angling of the sections relative to one another and to the roof shields 9. By making the length of the sections about equal to the distance between successive ones of the supports 2, and by associating hydraulic rams with the respective sections 20, the frames 5, 6 of the unit 4 may be so advanced along the roadway 1 that when the unit 4 is in operative (supporting) position the section 20 and the center sections 30 of the roof shields 9 are primarily located beneath the lintels of the supports 2 which require temporary supporting aid.

The pivotal connection of the hydraulic rams 24 to the sections 20 and the roof shields 9 enables the rams to accommodate themselves to any inclination of the sections 20 relative to the shields 9, without being subjected to damage due to transversely acting forces.

For practical reasons of underground application it is especially advantageous if the length of each roof shield end section 14 corresponds to the combined length of about four of the sections 20, and if the length of the roof shield center section 30 corresponds to the combined length of about three of the sections 20. Of course, this is by no means compulsory.

The arrangement composed of the elements 31, 32 acts as a parallel guidance device which prevents movements of the shields 19 relative to the shields 9 (or vice versa) in the longitudinal direction of unit 4. It also absorbs thrust resulting from minor inclination of the hydraulic rams relative to the sections 20 and shields 9 on the one hand, and the section 20 relative to the lintels of the supports 2 on the other hand. In other words, it keeps the rams from being subjected to transversely acting forces. It will be understood that the illustrated embodiment is merely one possible example and that other structural solutions may be employed.

By having the sole plates 8 and roof shields 9 connected to one another by hydraulic rams 13 only at their end sections 12, 14, and by also locating the four-bar linkages 15 at these end sections, a maximum amount of space is provided beneath the unit 4, especially in the area of the mouth of the gallery 3, to permit movement of personnel and of equipment between the gallery and the roadway.

The pivotal connection of the rams 7 to the frames 5, 6 permits the frames not only to be advanced lengthwise of roadway 1, but also transversely thereto so as to compensate for lateral deviation of the roadway, of the arrangement of the supports 2 and/or of the installation of mining equipment (e.g. conveyors). Of course, other devices (e.g. screw spindles) could be used in place of the hydraulic rams 7.

The lateral shields 33, 34 could also be biased by means other than the illustrated hydraulic rams (e.g. screw spindles). Appropriate arrangement of whatever means are used also permits the vertical position of these shields to be adjusted. In some conditions only one of the frames 5, 6 may be provided with such lateral shields; however, it is preferable to provide them on both frames since then the shields of one frame can support the wall 35 while the other frame is being advanced, and vice versa. The size of the lateral shields should preferably be accommodated to the area of wall 35 which is not being held by the supports 2 for the time during which the unit 4 assumes its temporary supporting function.

It is of particular advantage if each of the frames 5, 6 has two of the lateral shields, and if these are arranged one above the other. The upper lateral shields may then be so arranged that they can be displaced only horizontally against the wall 35, whereas the lower lateral shields should preferably be displaceable both horizontally and vertically by the associated rams or analogous devices. Finally, it is also advantageous if the length (in longitudinal direction of the roadway 1) of the lateral shields can be varied. This permits areas of the wall 35 to be supported which are temporarily devoid of such support ahead of the unit 4 (due to removal of the supports 2) or behind the unit 4 (due to advancement of the unit 4 and prior to reinstallation of the supports 2). The lateral shields may, for example, have parts which are pivotable about vertical axes by appropriate hydraulic rams or the like, into and out of operating position in which they are located in a plane with the remainder of the respective shield. Another possibility is to make a part of each shield shiftable relative to the remainder of the shield, in direction lengthwise of the unit 4.

While the invention has been illustrated and described as embodied in a walking mine support, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A walking mine support, particularly for supporting the area where a face gallery opens into a roadway provided with longitudinally spaced stationary supports, comprising a pair of adjacent supporting frames each having a multipartite sole plate and a multipartite roof shield; four-bar linkages connecting the sole plate with the roof shield of each frame; rams supporting the roof shield of each frame on the sole plate thereof with freedom of vertical adjustment; a multi-section overshield above each of said roof shields; a plurality of supports connecting each multi-section shield to the respective roof shield; and means for effecting step-wise advancement of said frames relative to one another in direction lengthwise of the roadway.

2. A walking mine support as defined in claim 1, wherein each of said multi-section shields comprises a plurality of individual shield sections, and means pivotally connecting adjacent ones of said shield sections for limited vertical pivoting, each of said supports connecting one of said shield sections with the respectively subjacent roof shield.

3. A walking mine support as defined in claim 2, wherein said shield sections each have a dimension lengthwise of said unit which corresponds substantially to the spacing between successive ones of the stationary supports in the roadway.

4. A walking mine support as defined in claim 2, wherein consecutive ones of said shield sections have limited freedom of relative movement lengthwise of said unit.

5. A walking mine support as defined in claim 2, said supports being hydraulic rams which are pivoted to the respective shield sections and subjacent roof shields.

6. A walking mine support as defined in claim 1, each of said roof shields being composed of a center section and two end sections pivoted to said center section for vertical pivoting movement, said center section having a length corresponding substantially to the combined length of three of said sections of said overshield, and said end sections each having a length corresponding substantially to the combined length of four of said sections of said overshield.

7. A walking mine support as defined in claim 1; and further comprising guide means connecting center portions of the respective roof shields and associated overshields to one another for joint parallel movement of the thus connected roof shields and overshields in direction lengthwise of said unit.

8. A walking mine support as defined in claim 7, said guide means comprising pairs of guide housings mounted at lateral sides of the respective roof shield and each having a substantially vertical passage, and guide members slidably received in said passages and being pivoted to the respective overshield for displacement about substantially horizontal pivot axes.

9. A walking mine support as defined in claim 1, said sole plate and roof shield of each of said frames each having two spaced end portions; and wherein said rams and said linkages connect the sole plate and roof shield of each frame only at said end portions.

10. A walking mine support as defined in claim 1, said sole plates constituting a first set of elements and said roof shields constituting a second set of elements; and wherein said means comprises length-variable devices connecting the elements of at least one of said sets with one another.

11. A walking mine support as defined in claim 10, wherein said devices are hydraulic rams.

12. A walking mine support as defined in claim 1; and further comprising lateral shield means on said unit for supporting portions of a sidewall bounding the roadway.

13. A walking mine support as defined in claim 12, said shield means comprising at least two shields, each provided on one of said frames.

14. A walking mine support as defined in claim 12, said shield means comprising at least two pairs of shields, each provided on one of said frames with one shield of each pair being arranged above the other shield of the pair.

15. A walking mine support as defined in claim 14, wherein each of said shields includes means for increasing and decreasing its length in longitudinal direction of said unit.

* * * * *